US011344142B2

(12) United States Patent
Kautz et al.

(10) Patent No.: US 11,344,142 B2
(45) Date of Patent: May 31, 2022

(54) DUAL-SIDED HYBRID MATERIAL PILLOW

(71) Applicants: Aaron Kautz, Tallahassee, FL (US); Adrianne Kautz, Tallahassee, FL (US)

(72) Inventors: Aaron Kautz, Tallahassee, FL (US); Adrianne Kautz, Tallahassee, FL (US)

( * ) Notice: Subject to any disclaimer, the term of this patent is extended or adjusted under 35 U.S.C. 154(b) by 0 days.

(21) Appl. No.: 16/155,828

(22) Filed: Oct. 9, 2018

(65) Prior Publication Data

US 2020/0107657 A1 Apr. 9, 2020

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47C 7/38; A47C 7/383
See application file for complete search history.

(56) References Cited

U.S. PATENT DOCUMENTS 2,944,266 A * 7/1960 Wertheimer ..... A47G 9/10 5/645
3,443,267 A * 5/1969 Schuckman ..... A47G 9/10 5/645
5,038,432 A * 8/1991 Robillard ..... A47G 9/10 5/645
5,638,564 A * 6/1997 Greenawalt ..... A47G 9/1081 5/636
6,363,557 B2 * 4/2002 Chou ..... A47G 9/0253 5/636
6,952,848 B1 * 10/2005 Strunk-Fellows ..... A47G 9/10 5/636
2005/0210590 A1 * 9/2005 DiGirolamo ..... A47G 9/10 5/636
2006/0075562 A1 * 4/2006 DiGirolamo ..... A47G 9/10 5/645
2006/0236460 A1 * 10/2006 Hooper ..... A47G 9/10 5/636
2008/0244832 A1 * 10/2008 Kuo ..... A47C 7/021 5/638
2014/0008036 A1 * 1/2014 Segal ..... A47C 21/046 165/46
2015/0040324 A1 * 2/2015 Dungan ..... A61F 7/02 5/644
2017/0042350 A1 * 2/2017 Mittal ..... A47G 9/10
2017/0099967 A1 * 4/2017 Holbrook ..... A47G 9/10
2017/0340131 A1 * 11/2017 Schmidt ..... A47G 9/10
2018/0213954 A1 * 8/2018 Grinstead ..... A47G 9/1036
2019/0298088 A1 * 10/2019 Li ..... A47G 9/10
2020/0154912 A1 * 5/2020 Del Balso ..... A47G 9/1027

* cited by examiner

*Primary Examiner* — Joshua T Kennedy
(74) *Attorney, Agent, or Firm* — Woodruff & Black, LLC; Paden E. Woodruff, IV

(57) ABSTRACT

A dual-sided pillow with an outer case, a semi-permeable barrier, a first fill compartment, and a second fill compartment. Said first fill compartment is preferably filled with a first fill material preferably being a polyester fiber faux down and said second fill compartment filled with a second fill material preferably being a polyester memory foam. The preferred embodiment utilizes a serged stitching, along its outer perimeter. The dual-sided pillow provides pressure relief for the cervical spine. The dual-sided pillow enables a user to attain a neutrally aligned spinal position and comfort while the user sleeps on his or her back and allows a user to immediately convert his or her pillow to enable a user to alleviate medical problems by sleeping on his or her side.

1 Claim, 2 Drawing Sheets

DUAL-SIDED HYBRID MATERIAL PILLOW

This application claims the benefit of U.S. Provisional Patent Application Ser. No. 62/569,483 filed Oct. 7, 2017 and entitled DUAL-SIDED HYBRID MATERIAL PILLOW, and incorporates this provisional application by reference in its entirety. The present invention generally relates to a pillow that provides pressure relief for the cervical spine. More specifically, the present invention relates to a pillow apparatus for enabling a user to attain a neutrally aligned spinal position and comfort while the user sleeps on his or her back and allows a user to immediately convert his or her pillow to enable a user to alleviate medical problems by sleeping on his or her side.

FIELD OF INVENTION

The present invention was designed by an experienced professional massage therapist, as a response to clients in search of a good night's sleep and to provide relief of cervical discomfort caused by improper cervical spinal support during sleep. The present invention was created as a solution appropriate for meeting the comfort needs of individuals regardless of body type or sleep style.

BACKGROUND OF THE PRIOR ART

The marketplace for pillows is highly varied, with many different pillow inventions claiming to serve a variety of different purposes in a variety of fields. Many different pillows have been invented for use in the medical field in surgery recovery. There are pillows designed to provide support while facing down during surgery or while undergoing an MRI to prevent movement but provide comfort. Other companies in the marketplace have sought to provide a pillow patients can use while wearing breathing devices, such as after a medical procedure, by designing pillows formed in specific shapes, such as a U-shape, to fit around medical devices.

There are pillow devices outside the medical field that utilize a rigid internal structure in an attempt to provide specialized support for different aspects of the upper body. Other variations of pillow devices utilize air pressure to provide an internal structure to support the user.

Other pillow devices seek to address medical problems experienced by users during sleeping, such as sleep apnea, by designing pillows that contour in specific ways around the neck area. The contouring feature appears in several pillows in the marketplace with the intent to keep the head from tilting to either the right or left side to minimize strain.

However, none of the pillow devices in the prior art provide practical, convenient support to the cervical spine. Accordingly, based on research and the work experience of the inventors in the relevant field, there is a need for an improved pillow device that is not cumbersome or overly complicated by the use of separate components, that is easy to maintain, and which automatically adjusts to the pressure of a user's body without the use of digital adjustment or electronics. The present invention is a revolutionary product specifically designed for two purposes. The present invention uses a base of shredded memory foam to provide a foundation for displaced faux down, allowing the faux down to stay in one place when pressure is applied by the user, sleeping on his back, for supporting and relieving pressure of the user's cervical spine. The loft of the down pushes upon the sides of the user's head to help prevent lateral rotation of the neck. Alternatively, the dual-sided pillow of the present invention also provides a firmer conforming support for side lying sleepers. A user sleeping on his side would want to sleep with the foam side up. Side sleepers use the faux down side of the preferred embodiment of the pillow to provide a foundation for the shredded memory foam. Sleeping on the side is preferable to sleeping on your stomach because it laterally rotates your neck/cervical spine putting unwanted strain on your sternocleidomastoids, scalenes, levator scapula, and trapezius, as well as extra pressure on your jaw and the muscles associated with it, such as the masseter and platysma. Side sleeping helps keep your airways open, which can alleviate sleep apnea. Additionally, sleeping on your left side is also recommended for women who are pregnant to improve circulation to the heart. Sleeping on the left side can also assist the lymphatic system as the left side of the body is the dominant lymphatic side. The majority of the body's lymph fluid drains to the thoracic duct, located on the left side. Along the way, lymph fluid carrying proteins, glucose and other metabolites and waste products is purified by lymph nodes and is then drained into the left side of the heart. When the lymphatic system congests, it is more likely that lymph will back upon the left, more lymph dominant side of the body.

The ability of the user to immediately convert the present invention from a back-sleeping pillow to a side sleeping pillow is not contemplated by the prior art and fills a much needed and desired niche in the marketplace.

SUMMARY OF INVENTION

The dual-sided pillow of the present invention addresses the aforementioned needs in the prior art by providing stabilization to the cervical spine while a user is sleeping in a supine position, on their side, or sitting. The present invention provides stabilization of the user's cervical spine with a two-section chamber system.

The dual-sided pillow of the present invention is comprised of an outer case, a semi-permeable barrier, and a plurality of compartments, at least two. In the preferred embodiment, a first compartment abuts a second compartment. Said semi-permeable barrier is disposed within the preferred embodiment of the present invention creating and separating said first compartment and said second compartment within said outer case, allowing for the passage of air between the two compartments. The outer boundaries of said first compartment and said second compartment are formed by said outer case, preferably made of a woven polyester fabric. In a preferred embodiment, said semi-permeable barrier is made of a spun polyester. In the preferred embodiment, the top section first compartment of the dual-sided pillow conforms to the pressure on the cervical spine. The bottom section second compartment provides structural support to the first compartment. In the preferred embodiment, the top section first compartment contains a faux-down filling which provides a soft loft which aids in the stabilization of the cervical spine while a user lies on top of the pillow apparatus in a supine position. In the preferred embodiment, the second compartment bottom section of the present invention contains shredded memory foam to provide firm support for the said affixed top section filling of faux-down and stabilizes extra pressure of the cranium into a neutral position.

A first fill material is disposed within said first compartment, said first fill material preferably being a polyester fiber faux down preferably having a linear density or fineness ranging from 1.0 to 6.0 Denier and first fill material preferably being between 30 mm to 102 mm long. The preferred polyester fiber faux down is preferred because it is thin and airy and has properties that allow the fibers to slide past each other, which helps distribute the weight of the user. Other materials having similar characteristics could be utilized for said first fill material instead of polyester fiber faux down, such as nylon, cotton, or a combination comprised of such materials. In a preferred embodiment, the pattern of the first fill material is siliconized although raw or other patterns could be used. In the preferred embodiment, the first fill material fiber type is staple. Siliconized polyester filler is a type of batting or filler created from synthetic fiber that is treated with a silicate material. This silicate material stiffens the polyester fibers, making them more resistant to bacteria and the accumulation of dust. The fibers help dry up the cell of the dust or bacteria as it comes in contact with the filling. Staple fibers are fibers that have a measurable, discrete length. For example, cotton and wool fibers are staple fibers.

A second fill material is disposed within said second compartment, said second fill material preferably being a polyester memory foam, said second fill material having a density between 15 kg/m3 and 30 kg/m3 at sea level and second fill material preferably being shredded to dimensions that range from ⅛" wide to 1" wide, ⅛" tall to 1" tall, and having a thickness ranging from 1/16" to ½". Other materials having similar characteristics could be utilized for said second fill material instead of polyester memory foam, such as polyurethane memory foam, cotton, other foam, or a combination comprised of such materials. Said second fill material is preferably shredded because, as compared to a larger piece of molded foam, the shredded material more evenly disperses the pressure of a user's head and thus better alleviates pressure on a user's cervical spine. An additional benefit of shredding the second fill material is that it allows for increased air flow relative to molded foam and other materials often used in the prior art, and thus has the preferred shredded first fill material has decreased heat retention therefore decreasing the temperature of the pillow apparatus.

The preferred embodiment's utilization of a polyester fiber for a first fill material and polyurethane memory foam for a second fill material provides a combination of softness and firmness that is not presently available in the commercial prior art. This combination of materials in the preferred embodiment simultaneously allows for a side-lying pillow and a back lying pillow. Side lying pillows are typically made of a uniform material, selected from materials similar to poly foam, bamboo, or other dense materials such that the pillow is firmer than average. Back lying pillows are typically made of a uniform material, selected from materials similar to faux down or shredded memory foam such that the pillow is softer than average. By utilizing both materials in the preferred embodiment in adjoining compartments the user can choose to utilize the present invention as either a side lying pillow or a back lying pillow.

The ratio of the first fill material to the second fill material in the preferred embodiment is 41:59 although the ratio of first fill material to second fill material can range from 35:65 to 65:35. The ratio of said first fill material and said second fill material is chosen such that the ratio achieved creates a loft of between 5 and 7 inches. Loft refers to a pillow's height as it lays on a flat surface. A pillow with a lower loft is shorter than a pillow with a higher loft. The preferred amount of first fill material in the preferred embodiment is 18 ounces and the preferred amount of the second fill material in the preferred embodiment is 25.4 ounces. The total weight of the pillow in the preferred embodiment is approximately 49 ounces but the weight can vary from 30 oz to 60 oz.

Although the present invention can be produced in a variety of sizes, the preferred embodiments of the invention are sized 20"×28", 20"×30", 20"×36", 20"×48", or 20"×54". Each of these sizes will be filled with a requisite stuffing giving the preferred embodiment a loft of between five and seven inches. In a preferred embodiment, the material chambers are made of materials that are nonwoven and spun bonded. The selection of this such materials ensures that first fill material or second fill materials are unable to leak out of the first compartment or the second compartment. In the preferred embodiment, the hole style of the semi-permeable membranes separating said first fill compartment and said second fill compartment is dot shaped, although alternative hole styles such as grid or solid can be used as well. The preferred hole style helps retain said first fill material inside said first compartment and said second fill material inside said second compartment and allows for breathability or air flow between outside of the pillow apparatus and the plurality of compartments. In a preferred embodiment, the material making up the semi-permeable barrier of the pillow comprises 96% polyester and 4% Chinlon. In a preferred embodiment the width of the walls of the pillow are between 0.3 millimeters and 2 millimeters thick. Other materials having similar characteristics could be utilized for the semi-permeable barrier of the pillow apparatus such as a polyester blend with a synthetic material. The weight of the preferred material for the walls of the pillow apparatus 100 grams per meter$^2$ but could range from 75 grams per meter$^2$ to 125 grams per meter$^2$. The yarn count of the preferred material for the preferred embodiment of the material chamber is 75 denier by 160 denier but could range from 32 denier×75 denier up to 100 denier×225 denier. The preferred type of yarn material cross grain and the cradts would be sanding but other variations are foreseeable and could be utilized instead.

DETAILED DESCRIPTION

Figure 1:
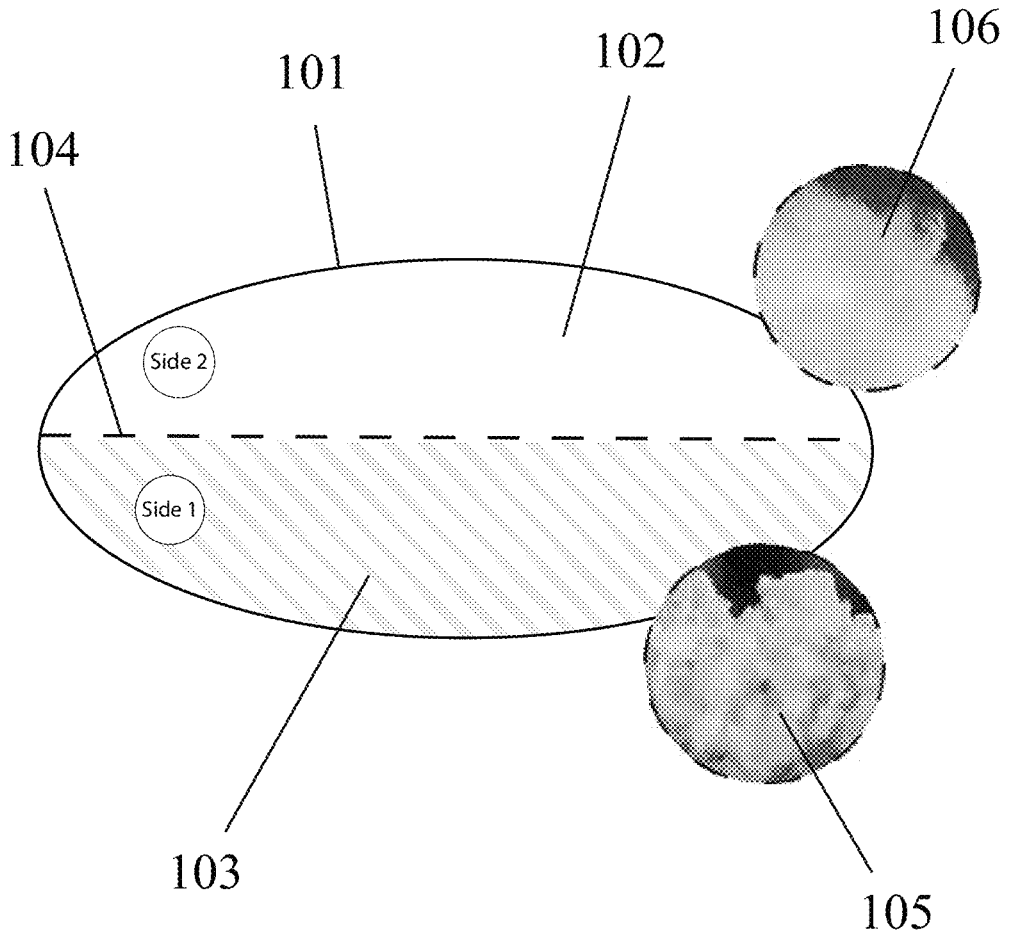
FIG. 1 Shows a cross-sectional view of the present invention.

FIG. 1 shows the main components of the present invention. The present invention comprises an outer case 101, a semi-permeable barrier 104, in a preferred embodiment a first fill compartment 102, and a second fill compartment 103. Said first fill compartment preferably filled with a first fill material 106 preferably being a polyester fiber faux down and said second fill compartment filled with a second fill material 105 preferably being a polyester memory foam.

Figure 2:
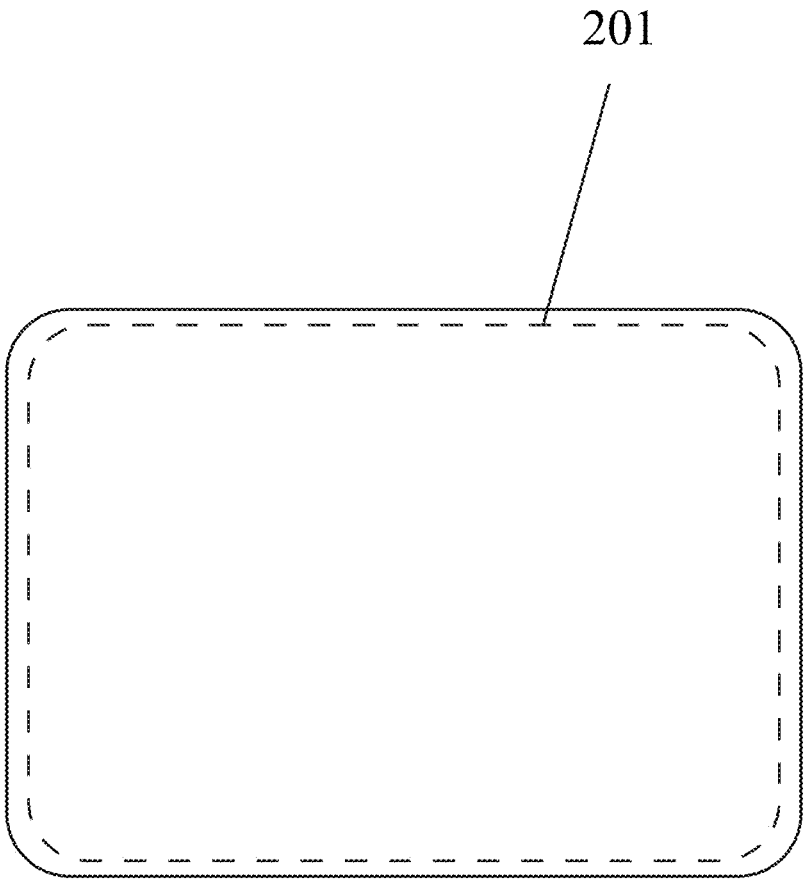
FIG. 2 Shows a top-view of the present invention

FIG. 2 shows a top view of the preferred invention. The preferred embodiment utilizes a serged stitching, 102, along its outer perimeter.

The invention claimed is:

1. A dual-sided hybrid therapeutic pillow comprising an outer case, a semi-permeable barrier, a first fill compartment filled with a first fill material selected from polyester fiber faux down, nylon, cotton, wool or a combination comprised of such materials, said first fill material having a linear density or fineness ranging from 1.0 to 6.0 Denier and first fill material preferably being between 30 mm to 102 mm long, a second fill compartment filled with a second fill material selected from polyester foam, cotton, or polyurethane foam, or a combination comprised of such materials, said second fill material having a density between 15 kg/m3 and 30 kg/m3 and second fill material being shredded to dimensions ranging from ⅛ inch wide to 1 inch wide, ⅛ inch tall to 1 inch tall, and having a thickness ranging from 1/16 inch to ½ inch; first fill compartment and second fill compartment having a material ratio ranging between 35:65 and 65:35 to create a pillow loft between 5 and 7 inches so that first compartment and second compartment are configured to be calibrated by a user's body pressure applied to either the first or second fill compartment to support and stabilize the cervical spine of a user in the supine position.

* * * * *